US007861450B2

(12) United States Patent
Curry

(10) Patent No.: US 7,861,450 B2
(45) Date of Patent: Jan. 4, 2011

(54) FIREARM HAVING NONMETALLIC COMPONENTS AND AN AMBIDEXTROUS CYLINDER RELEASE LEVER

(75) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 12/760,873

(22) Filed: Apr. 15, 2010

(65) Prior Publication Data

US 2010/0192440 A1 Aug. 5, 2010

Related U.S. Application Data

(63) Continuation of application No. 12/648,902, filed on Dec. 29, 2009.

(60) Provisional application No. 61/141,715, filed on Dec. 31, 2008, provisional application No. 61/169,356, filed on Apr. 15, 2009, provisional application No. 61/169,359, filed on Apr. 15, 2009.

(51) Int. Cl.
*F41C 3/14* (2006.01)

(52) U.S. Cl. ..... 42/62

(58) Field of Classification Search ..... 42/62, 42/64, 68

See application file for complete search history.

(56) References Cited

U.S. PATENT DOCUMENTS 1,518,027 A * 12/1924 Vosmek ..... 42/62
1,630,404 A * 5/1927 Nicholson ..... 42/62
3,387,399 A * 6/1968 McClenahan ..... 42/62
4,541,193 A * 9/1985 Flippin ..... 42/68
4,694,602 A * 9/1987 Pust ..... 42/59
D335,911 S * 5/1993 Militello ..... D22/108
6,330,761 B1 12/2001 Duval et al.
6,523,294 B2 2/2003 Curry et al.
7,059,075 B1 6/2006 Curry et al.
7,254,913 B2 8/2007 Dubois et al.
7,263,795 B1 9/2007 Curry

* cited by examiner

*Primary Examiner*—Troy Chambers
(74) *Attorney, Agent, or Firm*—McCormick, Paulding & Huber LLP

(57) ABSTRACT

A polymeric revolver including a frame, a cylinder mounted in a rectangular aperture in the frame, a cylinder retaining mechanism and a cylinder releasing mechanism is provided. The cylinder retaining mechanism includes two assemblies: (1) an extractor, locking bolt and locking bolt retainer that house an extractor rod spring, and (2) a ratchet hub driver, hub drive center pin and central pin plate that house a ratchet drive spring. The two assemblies are biased toward one another forming a locking engagement of the extractor and the ratchet hub driver. The locking engagement is enhanced by a star-shaped configuration of grooves and ridges on the extractor and ratchet hub driver, respectively. The cylinder releasing mechanism includes a cylinder release lever that actuates the hub drive center pin and ratchet hub driver out of locking engagement with the extractor, and an ambidextrous thumb piece that facilitates access to the cylinder release lever.

15 Claims, 12 Drawing Sheets

FIREARM HAVING NONMETALLIC COMPONENTS AND AN AMBIDEXTROUS CYLINDER RELEASE LEVER

CROSS-REFERENCE TO RELATED APPLICATIONS

The present application is a continuation of non-provisional U.S. patent application Ser. No. 12/648,902, filed on Dec. 29, 2009, which claims the benefit of provisional U.S. Patent Application Ser. No. 61/141,715, filed on Dec. 31, 2008; and also claims the benefit of provisional U.S. Patent Application Ser. No. 61/169,356, filed on Apr. 15, 2009, and provisional U.S. Patent Application Ser. No. 61/169,359, filed on Apr. 15, 2009, which are hereby incorporated by reference. The present application is related to U.S. patent application Ser. No. 12/760,927 filed on Apr. 15, 2010 and is hereby incorporated by reference.

FIELD OF THE INVENTION

The present invention relates generally to firearms and, more particularly, to a revolver having nonmetallic components and an improved cylinder releasing mechanism.

BACKGROUND OF THE INVENTION

As is well known in the art, a revolver includes four main components: a frame, a cylinder, a firing mechanism including a trigger and a barrel. The frame generally includes one or more frame portions, often a main frame portion, a hand grip portion, and a trigger guard. The cylinder is mounted on the frame by a yoke and fits within a window in the frame. The cylinder has formed therein a plurality of longitudinal bores ("chambers") for receiving cartridges. With each actuation of the trigger (i.e., a trigger pull), the cylinder rotates in the frame to successively present the chambers to the firing bore (the rear opening of the barrel) for firing. The cylinder also includes an ejector mechanism for removing spent cartridge casings subsequent to firing, and a cylinder retaining mechanism for holding the cylinder in place within the window in the frame during operation.

A retaining mechanism is necessary to retain the cylinder locked within a rectangular aperture, especially subsequent to firing. Many prior art revolvers lock the yoke directly into the frame via known means. Other revolvers use a ball detent to restrain the forward end of the cylinder. When a round is discharged, the forces which propel the round down the length of the barrel exert a corresponding force in the opposite direction, that is, towards the rear, handgrip portion of the revolver. Although the effect of this opposite force is marginal on the interconnected elements of the revolver, the manufacturing tolerances inherent in the revolver permit a minute amount of structural translation to occur as a result of this incident and opposite discharge force. The effect of the structural translation of certain elements in the revolver may cause the cylinder and yoke assembly to move slightly rearwards, causing, e.g., a ball detent to disengage, thus facilitating the unintended pivoting of the cylinder from its closed position toward its open position. In such a situation, the revolver must then be clicked back into its cylinder-closed position before additional firing. There is, therefore, a need for a cylinder retaining mechanism that will retain the cylinder within the frame during firing.

However, there is also a need for a cylinder releasing mechanism that will release the cylinder from the frame. Often, a cylinder release lever that can be moved via a thumb piece is provided to actuate the cylinder retaining mechanism and thereby allow the cylinder and yoke to be rotated away from the frame and into the cylinder-open position.

Cylinder release levers known in the art are usually provided along one side of the frame near the rear sight. In such a position, the cylinder release lever can be accessed by the user as desired and without a substantial risk of inadvertent actuation, for example, when cocking the hammer. However, the placement of the cylinder release lever on one side of the frame limits the functionality and convenience of the revolver.

Therefore, there is a need for a cylinder releasing mechanism that is accessible from both the left and right sides of the frame, whereby the cylinder releasing mechanism is equally accessible whether the revolver is held in the right or left hand of the user.

Yet, at the same time, there continues to be a concern that the cylinder release lever should be situated in a somewhat inaccessible position to prevent inadvertent actuation of the cylinder releasing mechanism. Accordingly, there is a need for a cylinder releasing mechanism that is positioned away from highly trafficked portions of the revolver.

Through the course of other advancements in revolver design, some revolvers have been developed that internalize the hammer by providing a protective casing, known as a shroud, around the hammer. As a result of the shroud, the user no longer has a need (or even ability) to manually cock the revolver by actuating said hammer.

Therefore, there is an opportunity for a cylinder releasing mechanism that is positioned on the upper rear surface of the frame, for instance, on the shroud.

In addition, as known in the art, yokes, onto which the cylinder is rotatably mounted, are pivotally mounted to the frame via an integral yoke stud. The yoke stud is generally secured by a pin or a clamp that is inserted through a hole in the frame, the pin or clamp being dispose in direct contact with the yoke stud.

There is an opportunity for a yoke retaining mechanism that is functionally integrated with other elements of the firearm.

SUMMARY OF THE INVENTION

In view of the foregoing, it is another object of the present invention to provide a revolver with an improved cylinder releasing mechanism.

It is another object of the present invention to provide a cylinder releasing mechanism that disengages the cylinder retaining mechanism when actuated.

It is another object of the present invention to provide a cylinder releasing mechanism that does not impede the cylinder retaining mechanism when in a resting or non-actuated position.

It is another object of the present invention to provide a revolver with an improved cylinder releasing mechanism that prevents the cylinder from coming out of battery during operation.

It is another object of the present invention to provide a cylinder release lever that is equally accessible and convenient to actuate when the firearm is held in either the left or right hand of the user.

It is another object of the present invention to provide a revolver with an improved cylinder release lever that facilitates ambidextrous actuation.

It is another object of the present invention to provide a revolver with an improved cylinder release lever that promotes the controlled release of the cylinder.

It is another object of the present invention to provide a cylinder release lever that is formed to substantially match the contour of the revolver whereby actuation of the cylinder release lever occurs in a controlled manner.

It is another object of the present invention to provide a cylinder release lever that is positioned on the upper rear frame of the revolver where, ordinarily, a hammer is positioned.

In another aspect of the present invention, a yoke retaining mechanism is provided that is integrated with a trigger guard retaining mechanism for a removable trigger guard. In another aspect of the present invention, the yoke retaining mechanism and the trigger guard retaining mechanism are secured to the frame of the firearm by a single pin.

According to an embodiment of the present invention, a cylinder release mechanism for a firearm is provided. The firearm has a frame defining an aperture with an annular opening on a breach surface thereof, a yoke rotatably mounted to the frame and having a cylindrical portion, a cylinder rotatably mounted to the cylindrical portion of the yoke. The cylinder release mechanism includes an extractor rotatably and reciprocally mounted in the cylindrical portion of the yoke, configured to engage the cylinder and having an annular ring fitted to be releasably inserted into the annular opening of the frame, wherein the cylinder is retained in a cylinder-closed position when the annular ring is inserted in the annular opening; a ratchet hub driver rotatably and reciprocally mounted in the annular opening of the frame, releasably engaged to the extractor and defining a rearward cylindrical opening; a hub drive center pin rotatably and reciprocally mounted in the rearward cylindrical opening of the ratchet hub driver and in the frame; and a cylinder release lever pivotally mounted to the frame and releasably engaged to the hub drive center pin; whereby actuation of the cylinder release lever reciprocates the hub drive center pin into engagement with the ratchet hub driver, the ratchet hub driver into engagement with the extractor and the annular ring of the extractor out of the annular opening of the frame, which releases the cylinder from the cylinder-closed position.

According to another embodiment of the present invention, an ambidextrous thumb piece for a cylinder release mechanism of a firearm is provided. The firearm has a frame with a rear surface, sides that abut the rear surface and grooves disposed along each side. The ambidextrous thumb piece includes: an elastically deformable U-shaped body having ends and opposing ridges that extend from the ends; wherein the ambidextrous thumb piece snap fits to the frame by engaging the grooves with the opposing ridges of the ambidextrous thumb piece; and whereby reciprocation of the ambidextrous thumb piece on the frame causes the ambidextrous thumb piece to actuate the cylinder release mechanism.

According to another embodiment of the present invention, a firearm having a cylinder release mechanism is provided. The firearm includes: a frame defining an aperture with an annular opening on a breach surface thereof and having a rear surface defining another aperture; a yoke rotatably mounted to the frame and having a cylindrical portion; a cylinder rotatably mounted to the cylindrical portion of the yoke; an extractor mounted in the cylindrical portion of the yoke, engaging the cylinder and having an inner ring fitted to engage the annular opening, wherein, when the inner ring is inserted in the annular opening, the cylinder is in a cylinder-closed position, and wherein the extractor is spring-biased toward the breach face; a ratchet hub driver mounted in the annular opening and releasably engaging the extractor; a hub drive center pin mounted in the frame and spring-biased into releasable, reciprocal engagement with the ratchet hub driver, wherein the hub drive center pin has an enlarged cylindrical portion; and a cylinder release lever rotatably mounted to the frame, having a first end releasably engaged to the enlarged cylindrical portion of the hub drive center pin and a second end that extends through the another aperture in the rear surface of the frame; wherein actuation of the cylinder release lever reciprocates the hub drive center pin into engagement with the ratchet hub driver, the ratchet hub driver into engagement with the extractor and the annular ring out of the annular opening, which releases the cylinder from the cylinder-closed position According to another embodiment of the present invention, a firearm is provided. The firearm includes: a frame defining a yoke stud recess; a yoke having a yoke stud rotatably inserted into the yoke stud recess; and a trigger guard mounted to the frame and engaging the yoke stud; wherein the engagement of the trigger guard to the yoke stud secures the yoke in pivotal engagement with the frame.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
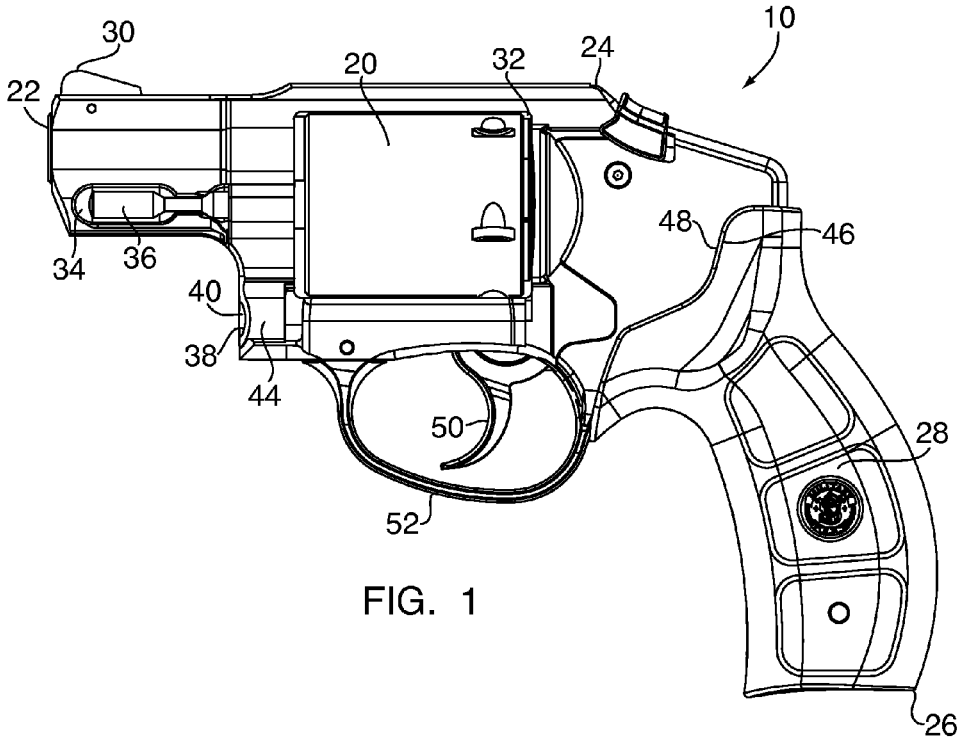
FIG. 1 is a side view of the revolver according to a first embodiment of the present invention.
Figure 2:
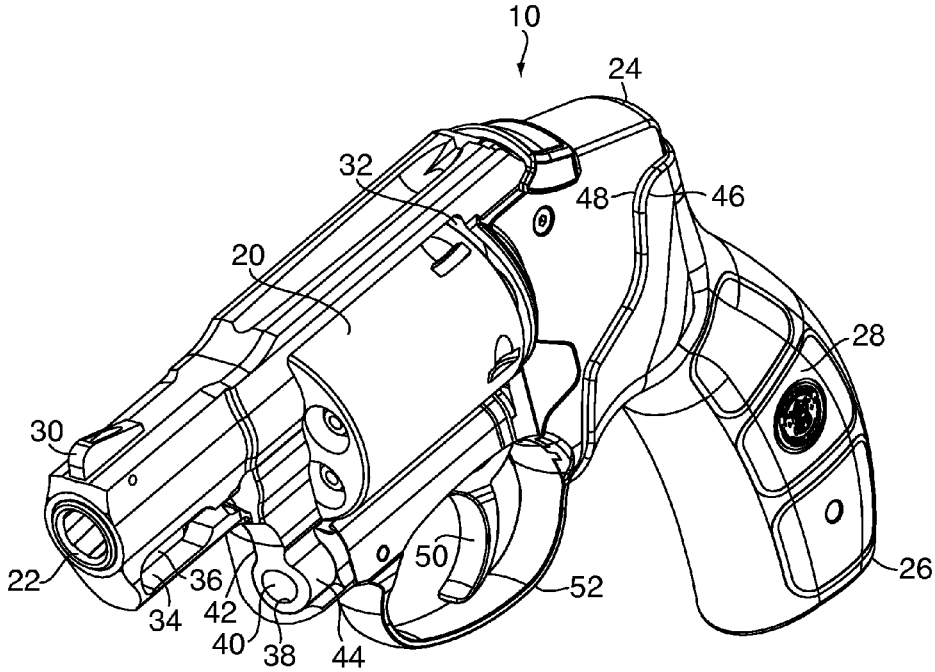
FIG. 2 is a perspective view of the revolver according to the embodiment of FIG. 1.

Referring to FIGS. 1 and 2, one exemplary embodiment of a firearm incorporating the present invention is shown generally at 10 and is hereinafter referred to as "firearm 10." The firearm 10 is preferably a revolver (as described in U.S. Pat. Nos. 6,330,781, 6,523,294, 7,059,075, 7,254,913 and 7,263,795 and provisional U.S. Patent Application No. 61/141,715, all of which are incorporated herein by reference) that includes a frame, a cylinder 20, a firing mechanism, and a barrel 22.

The frame is generally comprised of two main parts, an upper frame portion 24 and a lower frame portion 26. The lower frame portion 26 contains a back strap, main spring housing and a grip 28, as well as space for the firing mechanism.

The upper frame portion 24 contains the barrel 22 and a sight 30, as well as space for the firing mechanism. The upper frame portion 24 also contains: a rectangular aperture 32 for mounting the cylinder 20, a locking bolt recess 34 for slidably receiving the locking bolt 36, a yoke stud cavity 38, a yoke stud 40 secured in the yoke stud cavity 38, a yoke carve out 42 and a yoke 44 pivotally mounted on the yoke stud 40 into and out of the yoke carve out 42.

A forward end 46 of the lower frame portion 26 is shaped so as to accept a corresponding rearward end 48 of the upper frame portion 24. These upper and lower frame portions 24, 26 are joined together via pins to create a structurally rigid frame.

The frame portions 24, 26 are comprised of metal stampings or inserts having a polymer over-molding on top of the inserts. However, other metallic and nonmetallic materials may be used without departing from the scope of the present invention. While some prior art revolvers require hand fitting and bending to ensure that the barrel, cylinder, firing and locking mechanisms all come into registration within prescribed tolerances so that the revolver operates properly, such bending is not required with the polymer frame firearm 10 of the present invention.

The frame also includes a trigger 50 that is pivotally attached to the upper frame portion 24 and a separate trigger guard 52 that is removably attached to the upper frame portion 24.

The cylinder 20 is rotatably mounted on a cylindrical portion (see FIGS. 3 and 4) of the yoke 44. In other words, the cylinder 20 may be pivoted into and out of the rectangular aperture 32 in the upper frame portion 24 along the pivot path defined by the yoke 44 and/or rotated relative to the yoke 44.

Figure 3:
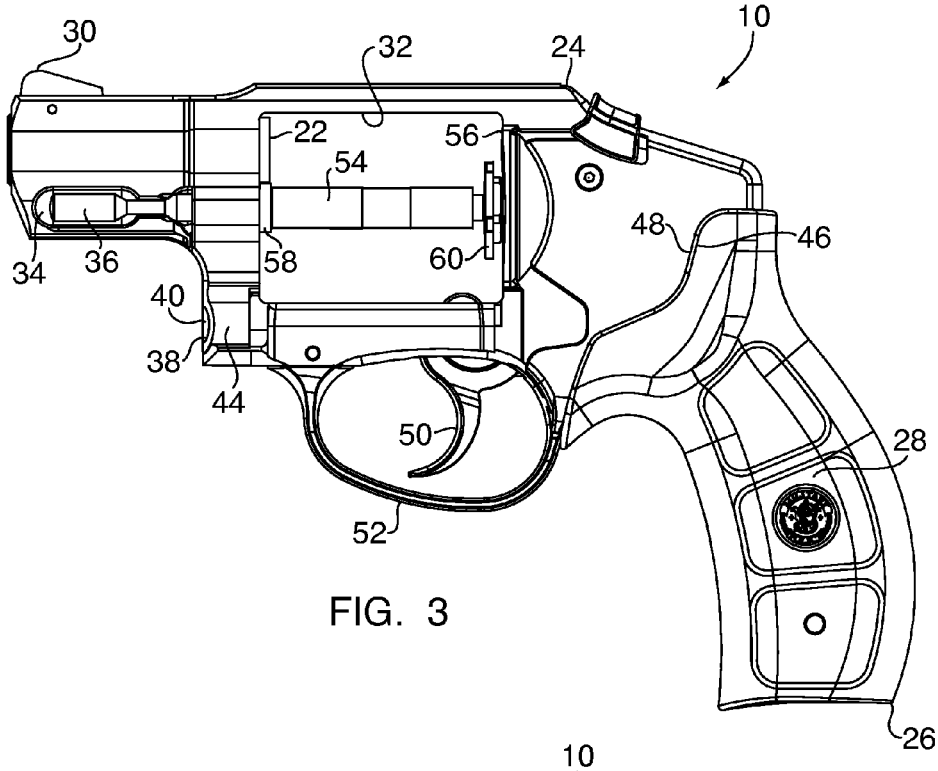
FIG. 3 is a side view of the revolver with the cylinder removed according to the embodiment of FIG. 1.
Figure 4:
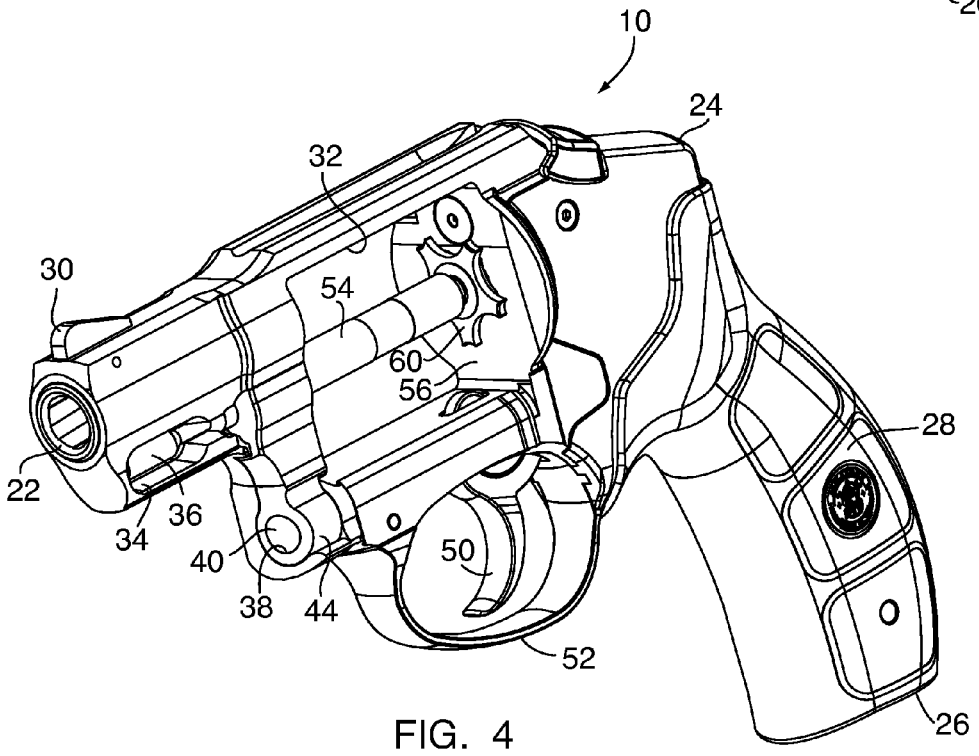
FIG. 4 is a perspective view of the revolver according to the embodiment of FIG. 3.

Referring now to FIGS. 3 and 4, the firearm 10 is shown with the cylinder removed to illustrate the rectangular aperture 32. Typically, as is shown in FIGS. 1 and 2, the cylinder 20 of an assembled firearm 10 would be rotatably mounted axially on a cylindrical portion 54 of the yoke 44 with a front face of the cylinder 20 substantially abutting a rear-facing inner surface of the frame and the rear face of the cylinder substantially abutting a front facing breach surface 56 of the frame. However, with the cylinder removed, it should be appreciated that the cylinder actually abuts the rear surface of the barrel 22 and an enlarged portion 58 of the yoke 44 on the front side of the firearm 10, and an extractor 60 on the rear side of the firearm 10. The barrel 22 to cylinder 20 gap is established by the size of the enlarged portion 58.

Figure 5:
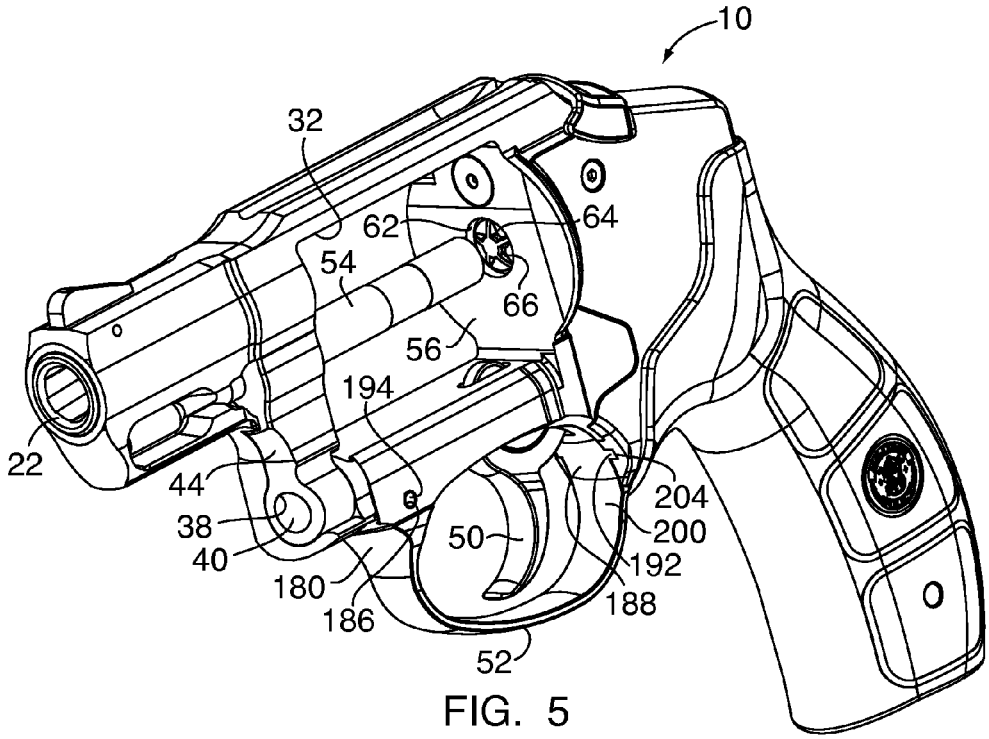
FIG. 5 is a perspective view of the revolver with the cylinder and extractor removed according to the embodiment of FIG. 1.

Referring now to FIG. 5, the firearm 10 is shown with the cylinder and the extractor removed. As shown, an annular opening 62 is provided in the breach surface 56 of the rectangular aperture 32, coaxial with the cylindrical portion 54. Slidably and rotatably mounted in the annular opening 62 is a ratchet hub driver 64 having a star-shaped configuration of ridges 66 on a front facing surface of a body portion 68 of the ratchet hub driver 64. The rearward face of the body portion 68 also includes an annular protruding ring 70 that is fitted to be received along the circumferential inside of the annular opening 62.

Figure 6:
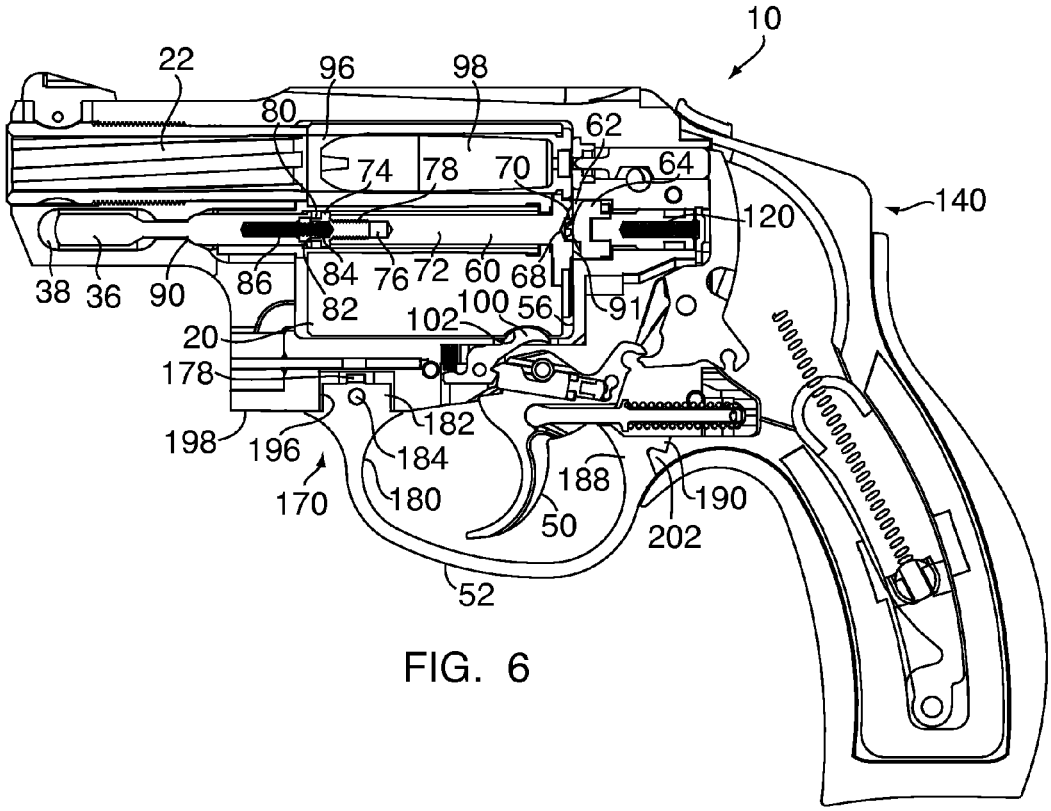
FIG. 6 is a side view of a cross section of the revolver according to the embodiment of FIG. 1.

Referring now to FIG. 6, a side view of a cross section of a fully assembled firearm 10 is shown. The rearward face of the body portion 68 of the extractor 60 rests flush against the breach surface 56 and is engaged by the spring-biased ratchet hub driver 64. The engagement between the extractor 60 and the ratchet hub driver 64 is enhanced by a complimentary star-shaped configuration of grooves 72 and the ridges 66 and on each element, respectively.

A frontward ejector rod assembly 74 of the extractor 60 connects to the locking bolt 36 via an extractor spring retainer 76. The extractor spring retainer 76 is mounted in a cylindrical recess 78 in the end of the ejector rod assembly 74 by means of a complimentary threaded screw and threaded groove engagement 80. The extractor spring retainer 76 includes a cylindrical extension 82, which is fitted to an opposing recess 84 in the locking bolt 36, and a coaxial recess 86 in the cylindrical extension 82, which receives the rearward end of an extractor rod spring 88. The opposing recess 84 in the locking bolt 36 receives the frontward end of the extractor rod spring 88. When compressed, the extractor rod spring 88 presses the locking bolt 36 against a narrow section 90 of the locking bolt recess 34.

Figure 7:
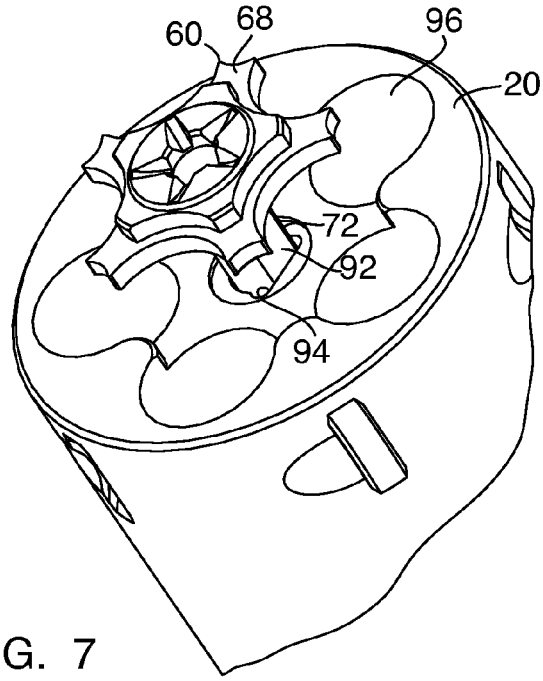
FIG. 7 is a perspective view of the extractor and cylinder according to the embodiment of FIG. 1.

The extractor spring retainer 76, the extractor rod spring 88, part of the ejector rod assembly 74 and part of the locking bolt 36 are removably and rotatably mounted inside the cylindrical portion 54. However, referring now to FIG. 7, a flattened surface 92 of the arcuate ejector rod assembly 74 engages a complimentary arcuate cylinder bore 94 positioned rearward on the cylinder 20, proximate to the body portion 68 when the cylinder 20 and the extractor 60 are assembled. The coupling of the arcuate ejector rod assembly 74 and the arcuate cylinder bore 94 creates a rotationally fixed engagement between the cylinder 20 and the extractor 60.

As shown in FIG. 6, the cylinder 20 includes chambers 96 that are configured to receive and align ammunition cartridges 98 with the barrel 22. When an ammunition cartridge 98 is aligned with the barrel 22, a cylinder stop 100 is pressed into an outer recess 102 in the cylinder 20 by the compressive force of a cylinder stop spring 104 placed on the distal end of the central pivot 106 of the cylinder stop 100. However, when the trigger 50 is actuated rearward (i.e., to discharge the chambered ammunition cartridge 98), a reset plunger 108 that is attached to the trigger 50 actuates the cylinder stop 100 downward causing the cylinder stop 100 to disengage the outer recess 102 thereby allowing the cylinder 20 to rotate.

Figure 8:
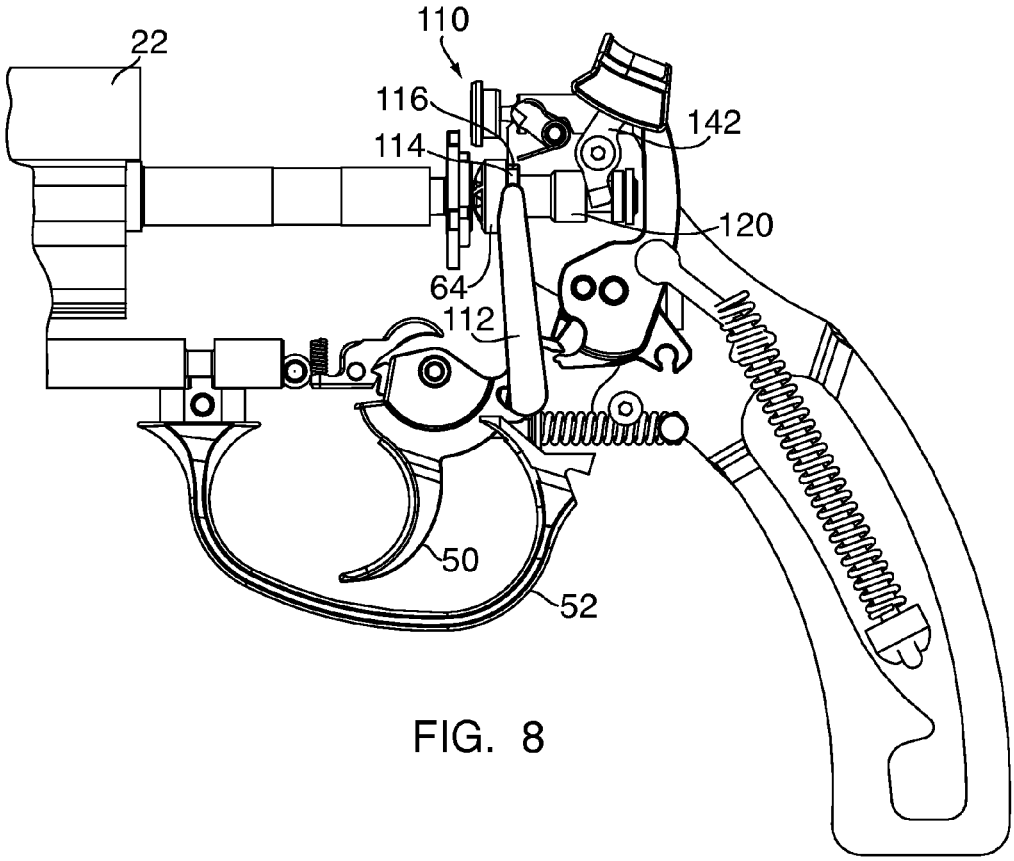
FIG. 8 is a side view of the firing mechanism, a cylinder retaining mechanism and a cylinder releasing mechanism according to the embodiment of FIG. 1.
Figure 9:
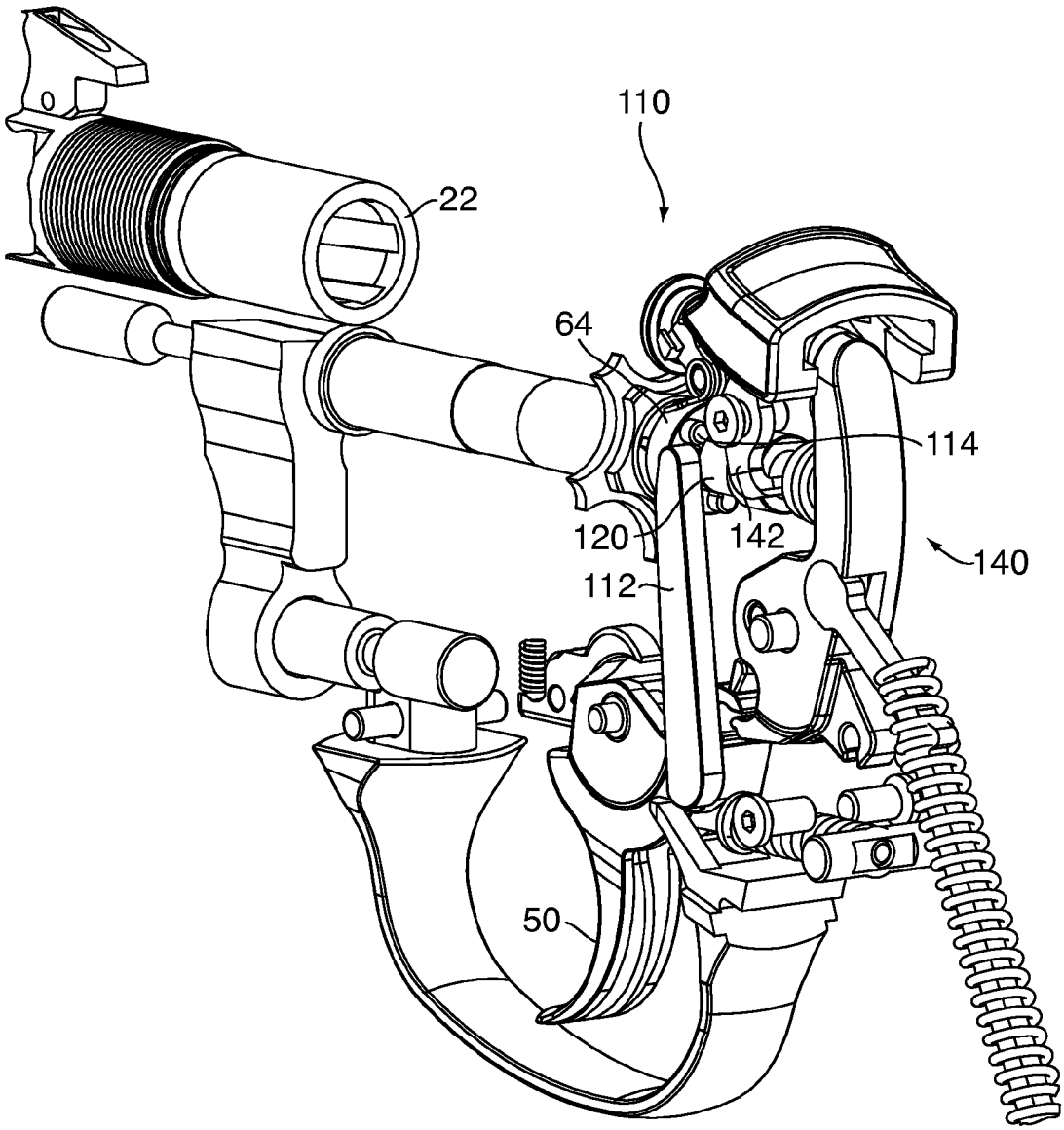
FIG. 9 is a perspective view of the mechanisms according to the embodiment of FIG. 8.

Referring now to FIGS. 8 and 9, a drive mechanism of the firearm is shown at 110. The drive mechanism 110 functions to rotate the cylinder 20 upon the pulling of the trigger 50 in order to place the next ammunition cartridge 98 into alignment with the barrel 22. In addition to arming and releasing the firing mechanism as described in provisional U.S. Pat. No. 6,141,715, which is incorporated herein by reference, the actuation of the trigger 50 causes an upward movement of a hand 112, which is pivotally mounted to the rear of the trigger 50. The hand 112, in turn, rotates the ratchet hub driver 64 by engaging and actuating annular-lobed ridges 114 provided at intervals around the circumference of the rear of the ratchet hub driver 64, with uniform radius cylindrical surfaces 116 positioned between each annular-lobed ridge 114. Each annular-lobed ridge 114 is a substantially semicircular cylindrical body. However, the annular-lobed ridges 114 can be made up of cylindrical bodies having in excess of 182 degrees of circumferential surface. In other words, the axial center of each annular-lobed ridge 114 can be positioned outside of the circumference of the uniform radius cylindrical surface 116 between each annular-lobed ridge 114. There are as many annular-lobed ridges 114 as there are chambers 96 in the cylinder 20, whereby each actuation of the trigger 50 corresponds to the amount of rotation required to align the next chamber 96 with the barrel 22.

Figure 10:
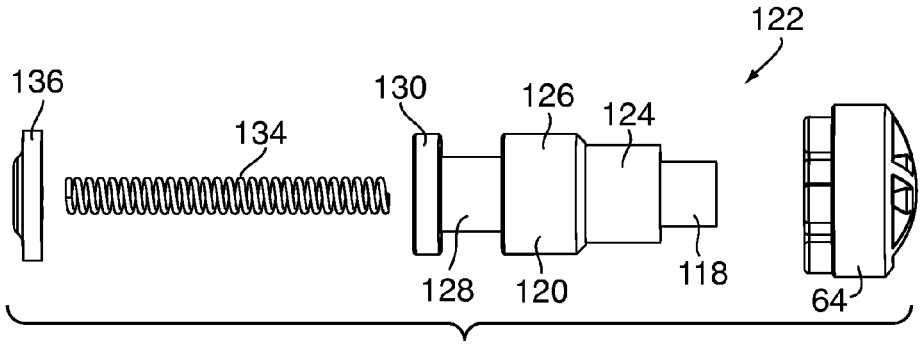
FIG. 10 is a side view of the ratchet hub driver, hub drive center pin, ratchet drive spring and center pin plate according to the embodiment of FIG. 1.
Figure 11:
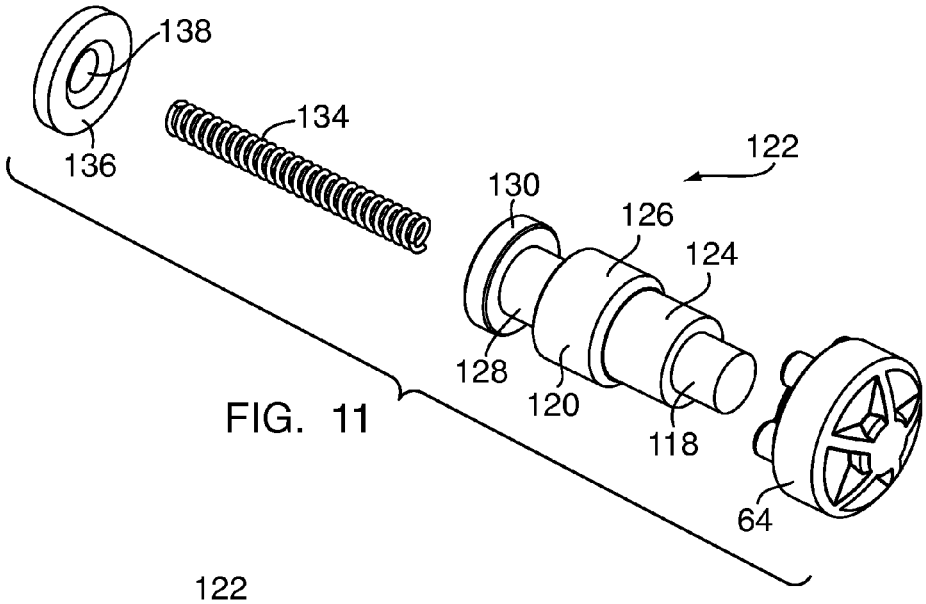
FIG. 11 is a perspective view of the ratchet hub driver, hub drive center pin, ratchet drive spring and center pin plate according to the embodiment of FIG. 10.
Figure 12:
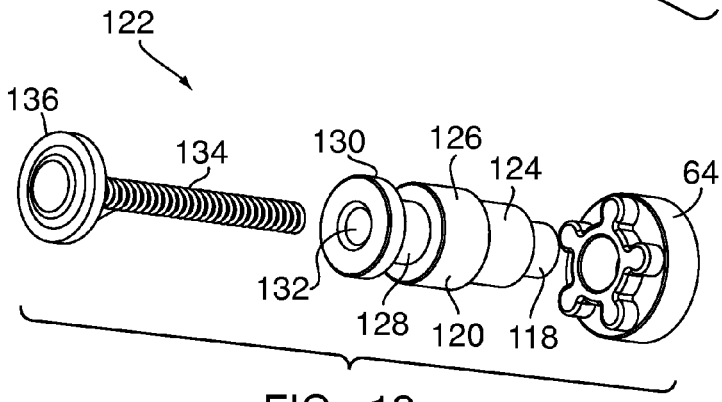
FIG. 12 is another perspective view of the ratchet hub driver, hub drive center pin, ratchet drive spring and center pin plate according to the embodiment of FIG. 10.

Typically, the ratchet hub driver 64 is mounted to a front cylindrical portion 118 of a hub drive center pin 120 as shown in FIG. 6. A hub drive arrangement including the hub drive center pin 120 is shown exploded at 122 in FIGS. 10-12.

To the rear of the front cylindrical portion 118, the hub drive center pin 120 also includes an intermediate cylindrical portion 124, an enlarged cylindrical portion 126, a narrow cylindrical portion 128, and an enlarged nub 130, respectively.

The hub drive center pin 120 is a substantially hollow annular member that is rotatably mounted to the frame. For instance, a pin recess 132 is provided axially through substantially the entirety of the hub drive center pin 120 with the mouth of the pin recess 132 being located on the rear face of the enlarged nub 130. Inside the pin recess 132, a ratchet drive spring 134 is housed, which, when compressed, exerts a resistive force on the hub drive center pin 120 that translates to the ratchet hub driver 64 causing the ratchet hub driver 64 to protrude from the annular opening 62, across the breach face 56 and, if the cylinder 20 is in the cylinder-closed position, into engagement with the extractor 60.

A center pin plate 136 abuts the rear annular face of the hub drive center pin 120. The center pin plate 136 is a substantially flat disk mounted in the frame at the rear of the annular opening 62 and provides an opposing surface against which the ratchet drive spring 134 is compressed. In particular, a central indentation 138 of the center pin plate 136 receives the rearward end of the ratchet drive spring 134.

According to one aspect of the present invention, a cylinder retaining mechanism 140 is provided to retain the cylinder 20 within the rectangular aperture 32, especially subsequent to firing. Referring now to FIGS. 8-12, the cylinder retaining mechanism 140 includes the extractor 60 and ratchet hub driver 64 in locking engagement. In the cylinder-closed position, the extractor 60 is pressed rearward by the resistive force of the compressed extractor rod spring 88 that also presses the locking bolt 36 forward against the narrow section 90 of the locking bolt recess 34. Whereas the ratchet hub driver 64 is pressed forward by the resistive force of the compressed ratchet drive spring 134 that also presses the central pin plate 136 against the frame near the rear of the annular opening 62. Accordingly, the extractor 60 and the ratchet hub driver 64 are biased into a locking engagement with one another. The locking engagement is enhanced by the complimentary star-shaped configuration of grooves 72 and ridges 66 provided on the extractor 60 and ratchet hub driver 64, respectively, ensuring proper alignment and improving tolerance characteristics.

To exemplify the cylinder-closing process, if the cylinder 20 is in the cylinder-open position (e.g., to replenish the ammunition cartridges 98 in the chambers 96) and it is desired to have the cylinder 20 in the cylinder-closed position, the cylinder 20 need only be pressed along the pivot path of the yoke 44 and into the rectangular aperture 32. As the cylinder 20 approaches the cylinder-closed position, the locking bolt 36 contacts the narrow section 90 of the locking bolt recess 34 and is forced rearward into a secured position, which causes the extractor 60 to press against the breach face 56 and the extractor rod spring 88 to compress. As the cylinder 20 draws still closer to the cylinder-closed position, the extractor 60 and ratchet hub driver 64 make contact and are forced away from one another by said contact, which causes the extractor rod spring 88 and ratchet drive spring 134 to compress. When the locking bolt 36 clears the narrow section 90, the locking bolt 36 snaps into engagement with the locking bolt recess 34. Eventually, for instance, upon an actuation of the trigger 50 or a rotation of the cylinder 20, the troughs of the star-shaped configuration of grooves 72 of the extractor 60 come into contact with the vertices of the star-shaped configuration of ridges 66 of the ratchet hub driver 64 and the extractor 60 and ratchet hub driver 64 snap into engagement with one another as the stored energy of the compressed ratchet hub spring 88 and ratchet drive spring 134 is released. At which point, the cylinder 20 is in the cylinder-closed position.

Figure 13:
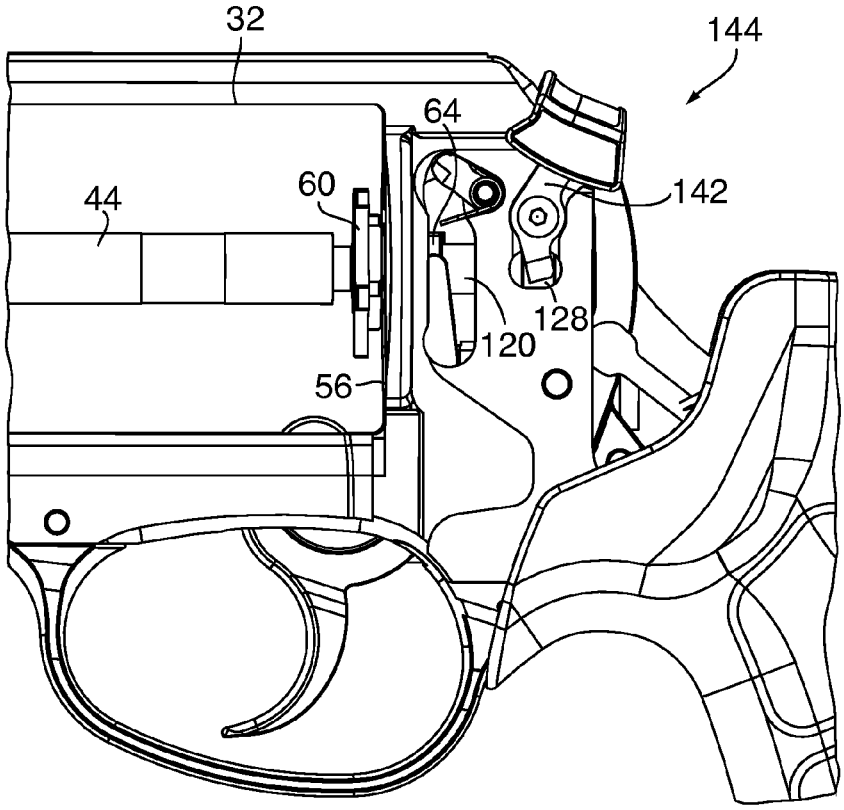
FIG. 13 is a side view of the revolver with the upper frame portion removed according to the embodiment of FIG. 1.

According to another aspect of the present invention, a cylinder releasing mechanism 144 is provided to release the cylinder 20 from the rectangular aperture 32. Referring to FIG. 13, the cylinder releasing mechanism 144 includes the hub drive center pin 120 and a cylinder release lever 142 that tangentially contacts the narrow cylindrical portion 128 of the hub drive center pin 120 through an ovular rear aperture in the frame.

Referring to FIGS. 8-9 and 13, when the cylinder release lever 142 is actuated, the hub drive center pin 120 is reciprocated rearward as the cylinder release lever 142 moves axially along its pivot path into engagement with the enlarged nub 130. The rearward motion of the hub drive center pin 120 causes the ratchet hub driver 64 to move rearward and disengage from the extractor 60. Once the ratchet hub driver 64 clears the breach face 56, the extractor 60 is able to rotate away from the annular opening 62 and, with the rotation of the extractor 60, the cylinder 20 is able to pivot outward from the rectangular aperture 32 on the yoke 44 into the cylinder-open position.

It should be appreciated that the corresponding star-shaped configuration of ridges 66 (see FIGS. 5, 8, 10 and 11) and grooves 72 (see FIGS. 6, 7) on the ratchet hub driver 64 and the extractor 60, respectively, continue to form a locking engagement until the ratchet hub driver 64 clears the breach face 56. At which point, the application of a lateral force to the side of the cylinder 20 causes the extractor 60 to slide along the breach surface 56 and the cylinder 20 to pivot outward from the rectangular aperture 32 along the pivot path of the yoke 44.

In order to facilitate actuation of the cylinder release lever 142, it may be necessary to provide a connecting element. The connecting element can be made in any number of shapes and sizes to satisfy a particular design need, such as providing the user with convenient access to the cylinder release lever 142. For example, the connecting element can be an ambidextrous thumb piece, as discussed below.

Figure 14:
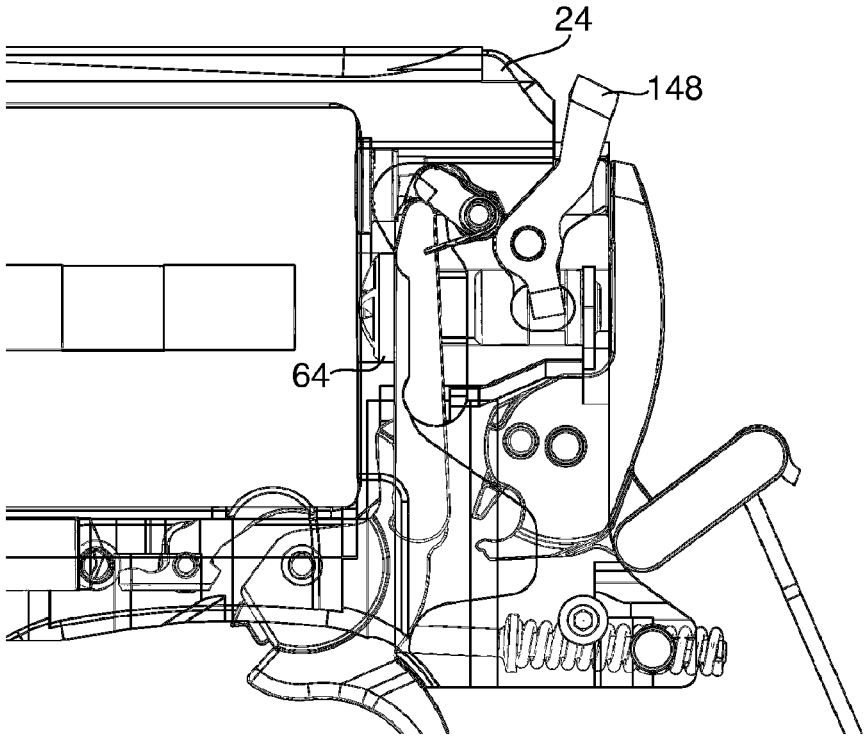
FIG. 14 is a side view of a revolver with the cylinder and the side panels removed and having a cylinder release lever in the actuated position according a second embodiment of the present invention.
Figure 15:
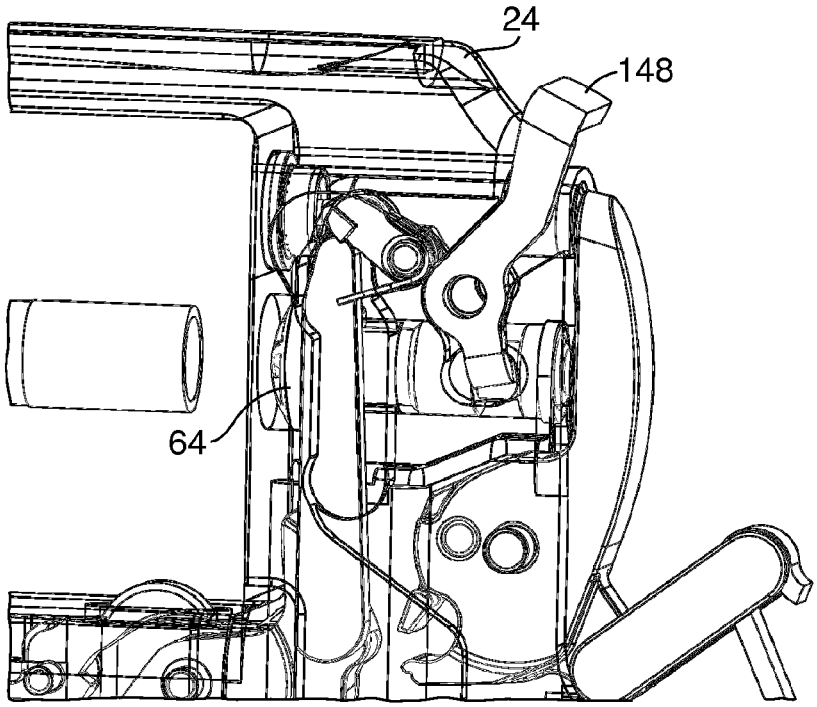
FIG. 15 is a perspective view of the revolver according to the embodiment of FIG. 14.
Figure 16:
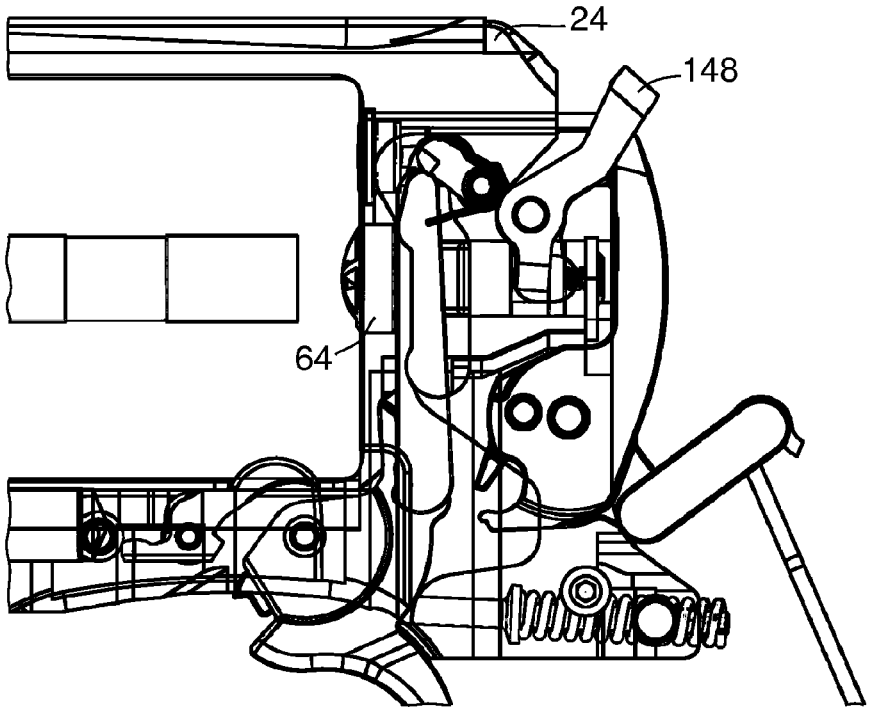
FIG. 16 is a side view of the revolver having a cylinder release lever in the un-actuated position according to the embodiment of FIG. 14.
Figure 17:
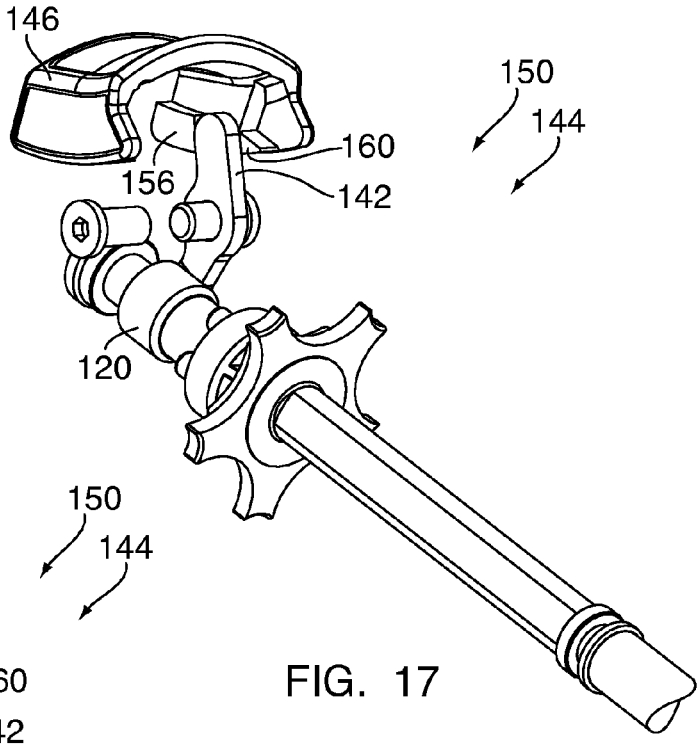
FIG. 17 is a perspective view of the cylinder releasing mechanism and the extractor according to the embodiment of FIG. 1.
Figure 18:
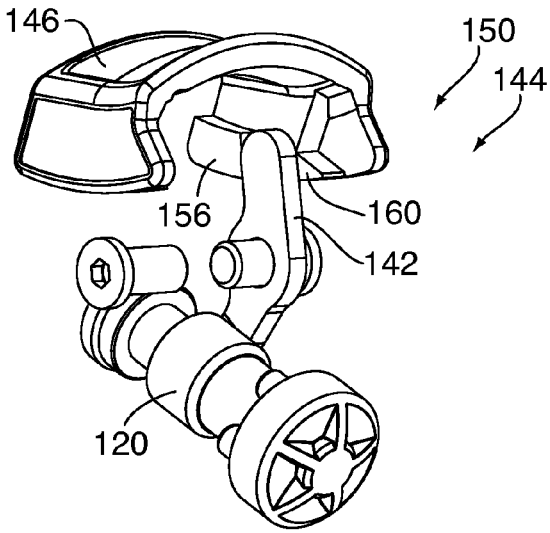
FIG. 18 is a perspective view of the cylinder releasing mechanism according to the embodiment of FIG. 1.
Figure 19:
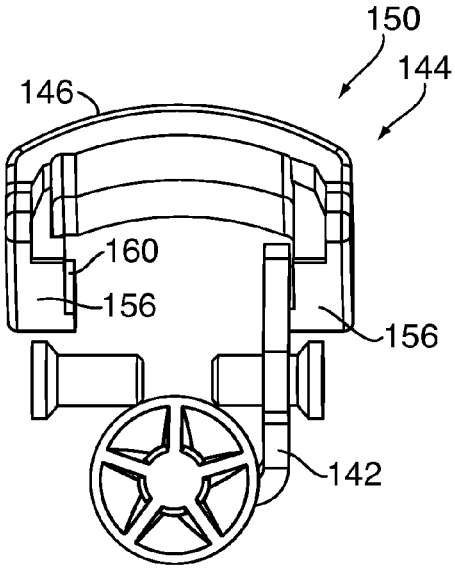
FIG. 19 is a front view of the cylinder releasing mechanism according to the embodiment of FIG. 18.
Figure 20:
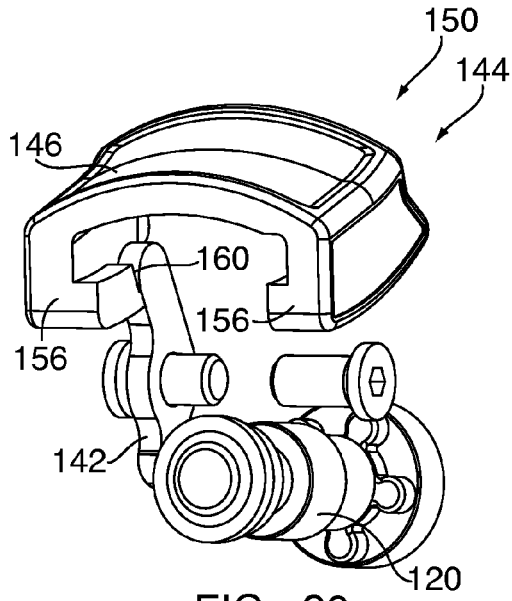
FIG. 20 is a perspective view of the cylinder releasing mechanism according to the embodiment of FIG. 18.

Alternatively, it should be appreciated that the cylinder release lever 142 shown in FIGS. 6 and 8-13 can be replaced with a cylinder release bar 146 as shown in FIGS. 14-16. The cylinder release bar 146 is a modified cylinder release lever 142 that is elongated to extend outward from the upper frame portion 24 and be accessible without the use of a connecting element. As illustrated between FIGS. 14 and 16, the cylinder release bar 146 is shown in the rearward and forward positions. The cylinder release bar 146 is shown in FIGS. 14 and 16 in positions corresponding to the rearward and forward positions of the ratchet hub driver 64, respectively, as well as the cylinder-open and cylinder-closed positions of the cylinder 20, respectively.

According to a third aspect of the present invention, the cylinder releasing mechanism 144 is provided that can be actuated with similar ease whether the firearm is held in the left or right hand of the user. Referring now to FIGS. 17-22, an ambidextrous releasing mechanism 150 includes the cylinder releasing mechanism 144 and an ambidextrous thumb piece 148 (i.e., the connecting element). The ambidextrous thumb piece 148 is mounted to the rear of the upper portion of the frame, substantially overlying the hub drive center pin 120 and the cylinder release lever 142.

In particular, the ambidextrous thumb piece 148 has a U-shaped body 152 that elastically deforms so that the ambidextrous thumb piece 148 can be press-fitted to a grooved portion 154 of the frame. The grooved portion 154 is sized to receive the ambidextrous thumb piece 148 and allow for reciprocal actuation of the same. The ambidextrous thumb piece 148 also includes a pair of opposing ridges 156 that protrude from the ends of the U-shaped body 152 towards each other and slidably mount to a pair of deeper grooves 158 in the frame. In particular, the deeper grooves 158 are located toward the distal end of the grooved portion 154 and are oriented substantially parallel to the outer surface of the frame. At least on the side that overlies the cylinder release lever 142, a carve out 160 is provided in the opposing ridge 156 to receive and engage the cylinder release lever 142.

For exemplary purposes, when the release of the cylinder 20 is desired, the ambidextrous thumb piece 148 is actuated forward along the frame. As the ambidextrous thumb piece 148 moves forward, the opposing ridge 156 abutting the carve out 160 engages and actuates the cylinder release lever 142. In turn, the cylinder release lever 142 actuates the remainder of the cylinder releasing mechanism 144, as discussed above, causing the cylinder 20 to be released into the cylinder-open position.

It should be appreciated that the ambidextrous thumb piece 148 is equally accessible from both sides of the firearm 10.

Figure 21:
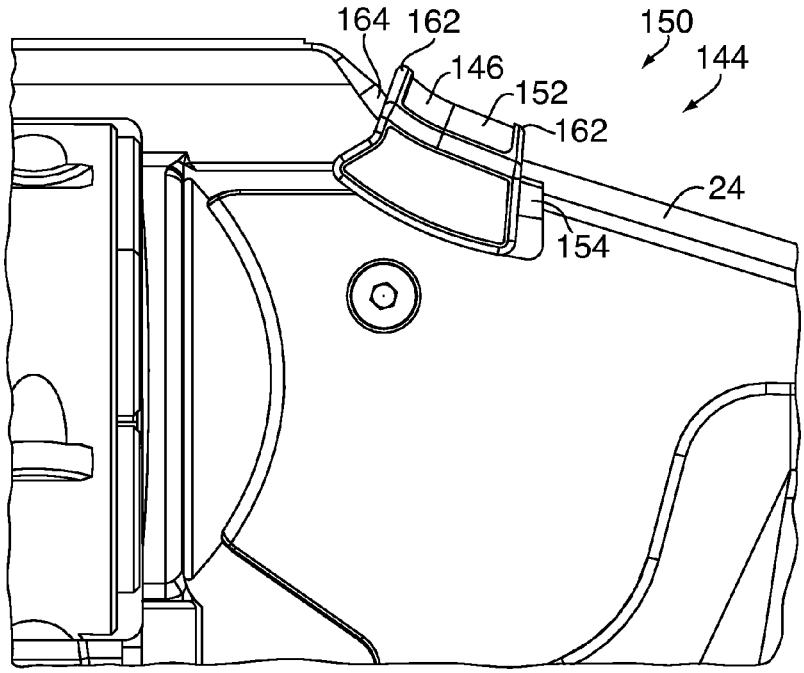
FIG. 21 is a side view of the cylinder release lever according to the embodiment of FIG. 1.
Figure 22:
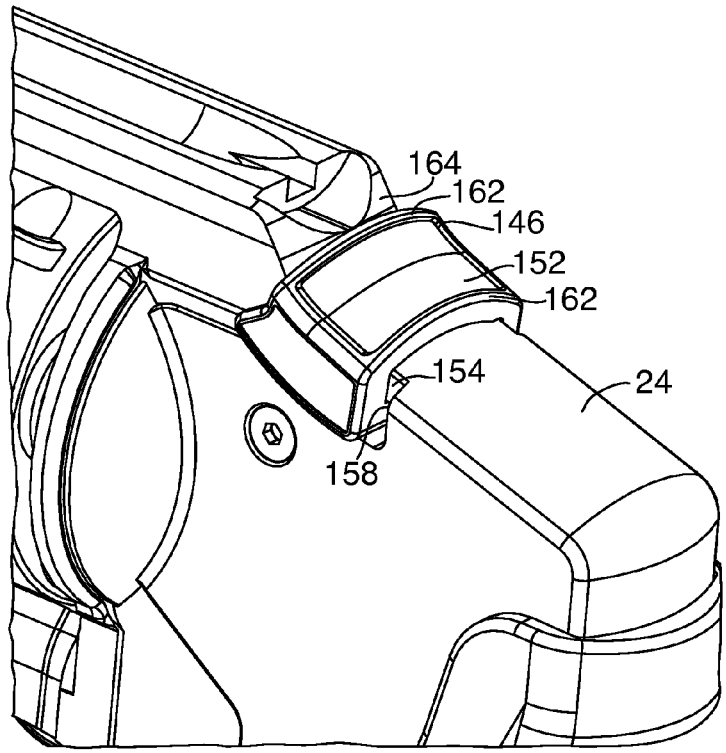
FIG. 22 is a perspective view of the cylinder release lever according to the embodiment of FIG. 1.

Referring now to FIGS. 21 and 22, the ambidextrous thumb piece 148 is shown mounted to the upper frame portion 24. Although the outer surface of the ambidextrous thumb piece 148 can include contours 162 or be textured to facilitate traction and engagement of the ambidextrous thumb piece 148, the ambidextrous thumb piece 148 is substantially flush with the overall shape of the frame, which prevents unintentional actuation of the ambidextrous thumb piece 148. For example, the ambidextrous thumb piece 148 is positioned in a concave recess 164 of the upper frame portion 24. In other words, the ambidextrous thumb piece 148 promotes the controlled actuation of the ambidextrous thumb piece 148 and, correspondingly, the controlled release of the cylinder 20 from the cylinder retaining mechanism 140.

Figure 23:
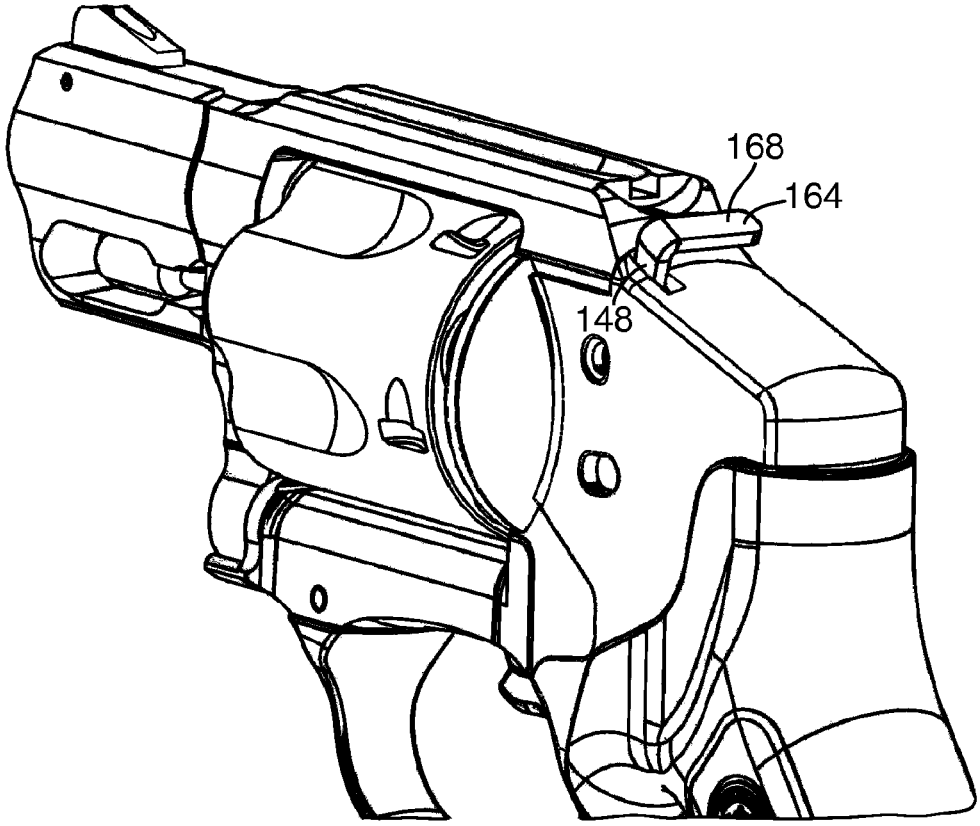
FIG. 23 is a perspective view of the revolver according to the embodiment of FIG. 14 with the cylinder and side walls intact.
Figure 24:
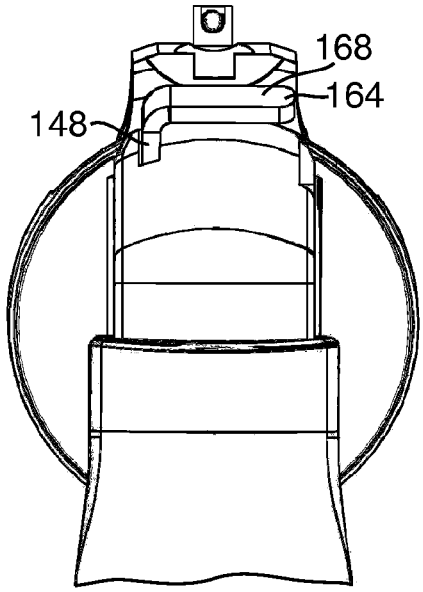
FIG. 24 is a rear view of the revolver according to the embodiment of FIG. 23.

Referring to FIGS. 23 and 24, an ambidextrous cylinder release bar, an alternative embodiment of the ambidextrous cylinder releasing mechanism 144, is shown at 164. In this embodiment, the cylinder release lever 142 is the cylinder release bar 146 with a lateral extension 166 that protrudes laterally across the rear of the upper surface of the frame. In this position and orientation, the ambidextrous cylinder release bar 164 can be accessed and actuated with similar ease when the firearm is held in either the left or right hand of the user.

It should be appreciated that in any of the above-discussed cylinder releasing mechanisms, the amount of force applied and displacement required to release the cylinder is substantially related to the characteristics of the springs and the geometry and placement of the cylinder release lever and, if present, the connecting element.

Figure 25:
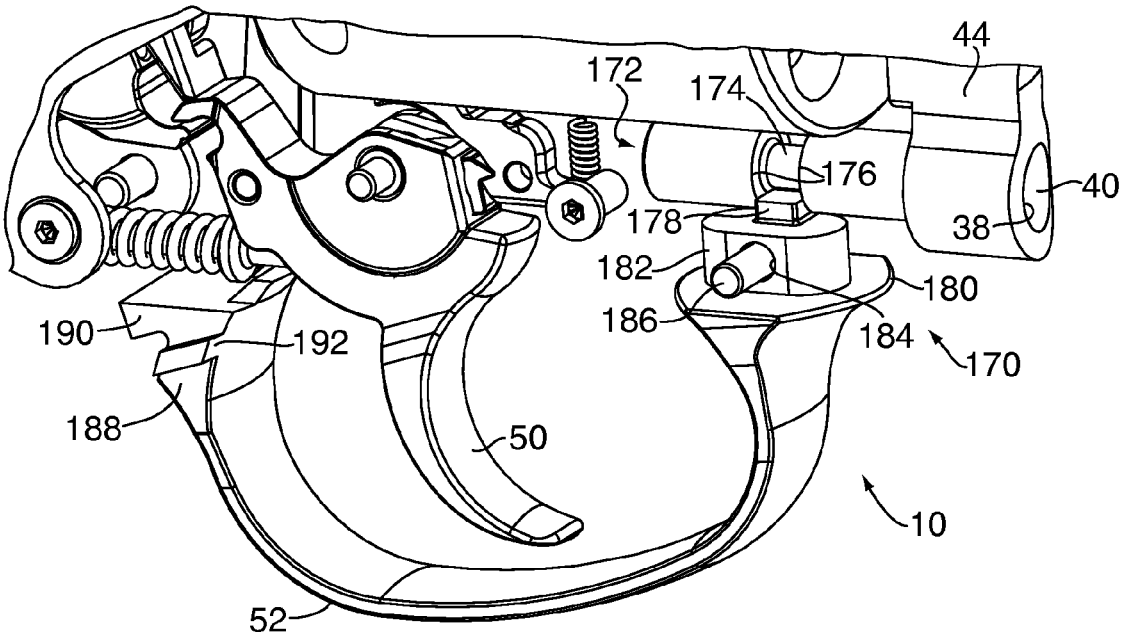
FIG. 25 is a perspective view of the revolver according to the embodiment of FIG. 1.

Referring to FIG. 25, a yoke retaining mechanism 170 is shown. As discussed above, the yoke 44 defines the yoke stud cavity 38, which receives the yoke stud 40 therein. The yoke stud 40 is a substantially cylindrical member received by a yoke stud recess (not shown) in the upper frame portion 24, the yoke stud recess being disposed substantially longitudinally at a position below the rectangular aperture 32 and offset from the center of the firearm 10. Toward a rear end 172 of the yoke stud 40, the yoke stud 40 includes a tapered portion 174 defining retaining walls 176. The tapered portion 174 receives a rectangular protrusion 178 that extends vertically upward from a front end 180 of the trigger guard 52 (see, e.g., FIG. 6). The rectangular fitting protrusion 178 abuts the retaining walls 176, thereby securing the yoke stud 40 within the yoke stud recess and the yoke 44 to the upper frame portion 24 of the firearm 10.

More specifically, the rectangular protrusion 178 extends from an offset position on an elliptical plug 182 disposed at the front end 180 of the trigger guard 52. The elliptical plug 182 defines a through-bore 184 fitted to receive a trigger guard pin 186. At a rear end 188 of the trigger guard 52, a hook 190 extends rearward and is abutted by a pair of longitudinally-oriented, lateral protrusions 192.

As shown in FIGS. 5-6, the upper frame portion 24 defines a trigger guard pin hole 194 at a position overlying and in communication with an elliptical front recess 196, which is formed in a lower surface 198 of the upper frame portion 24. Another trigger guard pin hole 194 is provided on the opposing side of the elliptical front recess 196. The trigger guard pin holes 194 align with the through-bore 184 of the elliptical plug 182 to receive the trigger guard pin 186 when the elliptical plug 182 is inserted into the elliptical front recess 196. Rearward along the lower surface 198, the upper frame portion 24 defines a substantially rectangular rear recess 200 having a retaining lip 202 abutting a pair of longitudinally-oriented, lateral grooves 204. The substantially rectangular rear recess 200 is fitted to receive the rear end 188 of the trigger guard 52. For instance, the hook 190 is fitted to the retaining lip 202 and the lateral protrusions 192 are fitted to the lateral grooves 204.

To illustrate the installation of the yoke 44 and the trigger guard 52 to the upper frame portion 24 of the firearm 10, the yoke stud 40 is, first, inserted into the yoke stud cavity 38 of the yoke 44 and the yoke stud 40 is inserted into the yoke stud recess of the upper frame portion 24. Next, the hook 190 on the rear end 188 of the trigger guard 52 is positioned in engagement with the retaining lip 202 and the trigger guard 52 is pivoted so that the elliptical plug 182 is fully inserted into the elliptical front recess 196. If the yoke stud 40 is fully inserted into the yoke stud recess, the rectangular portion 178 will slide into engagement with the tapered portion 174 of the yoke stud 40. Then, the trigger guard pin 186 is inserted into the trigger guard pin hole 194, through the through-bore 184 of the elliptical plug 182 and secured in the trigger guard pin hole 194 on the opposing side of the elliptical front recess 196. Once the trigger guard pin 186 is secured, the trigger guard 52 and the yoke 44 are securely mounted to the upper frame portion 24 of the firearm 10.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A cylinder release mechanism for a firearm having a frame defining an aperture with an annular opening on a breach surface thereof, a yoke rotatably mounted to the frame and having a cylindrical portion, a cylinder rotatably mounted to the cylindrical portion of the yoke, the cylinder release mechanism comprising:

an extractor rotatably and reciprocally mounted in the cylindrical portion of the yoke, configured to engage the cylinder and having an annular ring fitted to be releasably inserted into the annular opening of the frame, wherein the cylinder is retained in a cylinder-closed position when the annular ring is inserted in the annular opening;

a ratchet hub driver rotatably and reciprocally mounted in the annular opening of the frame, releasably engaged to the extractor and defining a rearward cylindrical opening;

a hub drive center pin rotatably and reciprocally mounted in the rearward cylindrical opening of the ratchet hub driver and in the frame; and a cylinder release lever pivotally mounted to the frame and releasably engaged to the hub drive center pin;

whereby actuation of the cylinder release lever reciprocates the hub drive center pin into engagement with the ratchet hub driver, the ratchet hub driver into engagement with the extractor and the annular ring of the extractor out of the annular opening of the frame, which releases the cylinder from the cylinder-closed position.

2. The cylinder release mechanism of claim 1, wherein the extractor defines a cylindrical recess on a remote end of the extractor from the annular ring; and the cylinder release mechanism further comprises:

an extractor rod spring having one end mounted in the cylindrical recess; and a locking bolt rotatably and reciprocally mounted in the cylindrical portion of the yoke, releasably engaged to the extractor and defining an opposing recess that receives a second end of the extractor rod spring;

wherein, in the cylinder-closed position, the locking bolt engages the frame to compress the extractor rod spring, which spring-biases the annular ring into the annular opening.

3. The cylinder release mechanism of claim 1, wherein the hub drive center pin defines a pin recess in a remote end from the engagement with the ratchet hub driver; and the cylinder release mechanism further comprises:

a ratchet hub drive spring having one end mounted in the pin recess; and a center pin plate mounted to the frame and defining a central indentation that receives a second end of the ratchet hub drive spring;

wherein, in the cylinder-closed position, the extractor is inserted into the annular opening, which actuates the ratchet hub driver into engagement with the hub drive center pin to compress the ratchet hub drive spring, which spring-biases the hub drive center pin into engagement with the ratchet hub driver and the ratchet hub driver into engagement with the extractor.

4. The cylinder release mechanism of claim 1, wherein the frame has a rear surface that defines a rear aperture therein; and wherein a distal end of the cylinder release lever from the hub drive center pin extends through the rear aperture.

5. The cylinder release mechanism of claim 4, wherein the distal end of the cylinder release lever is bent and extends laterally across the rear surface of the frame.

6. The cylinder release mechanism of claim 1, wherein the frame has a rear surface; and the cylinder release mechanism further comprises:

an ambidextrous thumb piece reciprocally mounted to the rear surface of the frame and releasably engaged to the distal end of the cylinder release lever from the hub drive center pin.

7. The cylinder release mechanism of claim 6, wherein the ambidextrous thumb piece lies substantially flush against the rear surface of the frame.

8. The cylinder release mechanism of claim 6, wherein the ambidextrous thumb piece further comprises contours or texturing.

9. The cylinder release mechanism of claim 6, wherein the ambidextrous thumb piece extends laterally across the rear surface of the frame.

10. The cylinder release mechanism of claim 6, wherein the frame has sides abutting the rear surface, the sides defining grooves proximate the rear surface;

wherein the ambidextrous thumb piece has an elastically deformable U-shaped body with ends and opposing ridges that extend towards each other from the ends; and wherein the ambidextrous thumb piece snap fits to the frame by engaging the grooves of the frame with the opposing ridges of the ambidextrous thumb piece.

11. The cylinder release mechanism of claim 10, wherein at least one of the opposing ridges of the ambidextrous thumb piece defines a carve out; and wherein the cylinder release lever abuts the opposing ridges along the carve out to engage the ambidextrous thumb piece.

12. The cylinder release mechanism of claim 1, wherein the hub drive center pin further comprises a narrow cylindrical portion disposed between an enlarged cylindrical portion and an enlarged nub; and wherein the cylinder release lever abuts the enlarged cylindrical portion or the enlarged nub along the narrow cylindrical portion to engage the hub drive center pin.

13. A firearm having a cylinder release mechanism, the firearm comprising:

a frame defining an aperture with an annular opening on a breach surface thereof and having a rear surface defining a rear aperture;

a yoke rotatably mounted to the frame and having a cylindrical portion;

a cylinder rotatably mounted to the cylindrical portion of the yoke;

an extractor mounted in the cylindrical portion of the yoke, engaging the cylinder and having an inner ring fitted to engage the annular opening, wherein, when the inner ring is inserted in the annular opening, the cylinder is in a cylinder-closed position, and wherein the extractor is spring-biased toward the breach face;

a ratchet hub driver mounted in the annular opening and releasably engaging the extractor;

a hub drive center pin mounted in the frame and spring-biased into releasable, reciprocal engagement with the ratchet hub driver, wherein the hub drive center pin has an enlarged cylindrical portion; and a cylinder release lever rotatably mounted to the frame, having a first end releasably engaged to the enlarged cylindrical portion of the hub drive center pin and a second end that extends through the rear aperture in the rear surface of the frame;

wherein actuation of the cylinder release lever reciprocates the hub drive center pin into engagement with the ratchet hub driver, the ratchet hub driver into engagement with the extractor and the annular ring out of the annular opening, which releases the cylinder from the cylinder-closed position.

14. The firearm of claim 13, wherein the cylinder release lever is bent and extends laterally across the rear surface of the frame.

15. The firearm of claim 14, wherein the cylinder release lever is equally accessible from both sides of the firearm.

* * * * *